US006709369B1

(12) United States Patent
Jacobs

(10) Patent No.: US 6,709,369 B1
(45) Date of Patent: Mar. 23, 2004

(54) EXERCISE APPARATUS

(76) Inventor: Robert Jacobs, 1121 Portofino Ct. #103, Corona, CA (US) 92881

( * ) Notice: Subject to any disclaimer, the term of this patent is extended or adjusted under 35 U.S.C. 154(b) by 221 days.

(21) Appl. No.: 10/112,202

(22) Filed: Mar. 29, 2002

(51) Int. Cl.[7] ..... A63B 21/00
(52) U.S. Cl. ..... 482/80; 482/79; 482/124
(58) Field of Search ..... 602/27, 28, 623; 482/79, 80, 121, 124, 907, 145, 146, 147

(56) References Cited

U.S. PATENT DOCUMENTS 2,439,100 A * 4/1948 Richards
2,536,454 A * 1/1951 McIntyre

FOREIGN PATENT DOCUMENTS

DE 000548527 A * 10/1932 ..... 602/28
FR 000493196 A * 8/1919 ..... 602/28
FR 000523538 * 8/1921 ..... 602/28
SU 001323103 A * 7/1987 ..... 602/28

* cited by examiner

*Primary Examiner*—Jerome W. Donnelly

(57) ABSTRACT

An exercise apparatus is described which when used can improve the muscle tone and/or strengthen the calve muscles of a user. The exercise apparatus comprises a riser extension attached to the bottom end portion of a foot plate in which the user may exercise the calve muscles by rocking the foot plate up and down while maintaining contact with a floor surface with the riser extension. The exercise apparatus also comprises a means for securing the users foot onto the foot plate. A thigh harness is connected to the foot plate with at least one tension member which provides resistance to the users efforts in rocking the foot plate up and down.

20 Claims, 4 Drawing Sheets

EXERCISE APPARATUS

FIELD OF THE INVENTION

The present invention relates to exercise apparatus and more particularly to an exercise apparatus for conditioning and strengthening calve muscles of a user.

DESCRIPTION OF THE PRIOR ART

In the hectic modern day life style, experience by many people, it is often difficult to find either the time or the motivation to exercise. Of course exercise is yields great physical and mental benefits to those that do exercise. However, under the constraints of modern day life styles, exercise regimens are usually avoided due to the expense and hassle of joining a gym. In an effort to avoid the expense and hassle of gyms many people opt to exercise at home. However, home exercise regimens are limited by the space available and the expense of purchasing individual pieces of equipment. Due to this dilemma many people either do not exercise at all or only perform a few isometric exercises which isolate certain muscle groups. One of the most popular muscle groups to isolate and exercise, for aesthetic reasons among others, are calf muscles. Unfortunately, calf muscles do not respond well to isometric exercises as they do with resistance exercising. Therefore, it would be a benefit to have an exercise device which is light weight and easy to use at home. It would be a further benefit to have an exercise device which is inexpensive. It would be a further benefit to have an exercise device which allows for resistance training of the calf muscles.

A number of arrangements have been suggested in the prior art for providing exercise devices to overcome the objectional features of identifying a convenient and effective exerciser device for toning and strengthening calve muscles. Among these are the exercise device described by Mikell in U.S. Pat. No. 2,467,943 discloses a pair of rigid foot engaging rod member in which the members are disposed beneath the toes and immediately back of the ball of the user's foot. Attached to the rod members are a spring and a spacer unit connected to a knee harness. However, the Mikell disclosure is silent with regards to a riser extension unit attached to the bottom rear portion of a foot plate so that the user may be able to rock the foot plate up and down while maintaining contact with a floor surface with the bottom of the riser extension unit. Other disclosures including: the ankle and foot exercise apparatus disclosed by Williams in U.S. Pat No. 4,371,161; the night splint for a foot described by Miller in U.S. Pat. No. D434,504; the calf exerciser described by Scott in U.S. Pat. No. D320,825; the exercise device disclosed by Robles in 5,489,251; the exercising device for the fingers, wrist and forearm disclosed by Kauffman in U.S. Pat. No. 4,310,154; and the passive exercising device disclosed by Hajianpour in U.S. Pat. No. 4,538,595 all suffer the same disadvantages and limitations as noted above.

While all of the above-described devices fulfill their respective, particular objectives and requirements, the aforementioned patents do not describe a riser extension unit attached to the bottom rear portion of a foot plate so that the user may be able to rock the foot plate up and down while maintaining contact with a floor surface with the bottom of the riser extension unit that would specifically match the user's particular individual needs. The above-described patents make no provision for a riser extension unit attached to the bottom rear portion of a foot plate so that the user may be able to rock the foot plate up and down while maintaining contact with a floor surface with the bottom of the riser extension unit.

Therefore, a need exists for a new and improved exercise apparatus that can be used for improving muscle tone and strength in a user's calve muscles. In this respect, the exercise apparatus according to the present invention substantially departs from the conventional concepts and designs of the prior art, and in doing so provides an apparatus primarily developed having a riser extension unit attached to the bottom rear portion of a foot plate so that the user may be able to rock the foot plate up and down while maintaining contact with a floor surface and the bottom of the riser extension unit.

SUMMARY OF THE INVENTION

An exercise apparatus is described which when used can improve the muscle tone and/or strengthen the calve muscles of a user. The exercise apparatus comprises a riser extension attached to the bottom end portion of a foot plate in which the user may exercise the calve muscles by rocking the foot plate up and down while maintaining contact with a floor surface with the riser extension. The exercise apparatus also comprises a means for securing the users foot onto the foot plate. A thigh harness is connected to the foot plate with at least one tension member which provides resistance to the users efforts in rocking the foot plate up and down.

In view of the foregoing disadvantages inherent in the known type exercise devices now present in the prior art, the present invention provides an improved exercise apparatus, which will be described subsequently in great detail, is to provide a new and improved exercise apparatus which is not anticipated, rendered obvious, suggested, or even implied by the prior art, either alone or in any combination thereof.

To attain this, the present invention essentially comprises a riser extension attached to the bottom rear portion of a foot plate. The foot plate having a means for securing the users foot onto the foot plate. Resistive force is provided by at least one tension member attached between the foot plate and a thigh harness.

There has thus been outlined, rather broadly, the more important features of the invention in order that the detailed description thereof that follows may be better understood, and in order that the present contribution of the art may be better appreciated.

The invention may also include a U-shaped brace attached to the bottom front portion of the foot plate, a pair of pivot plates attached to the U-shaped brace, a pair of straps for securing a desired tension between the thigh harness and the foot plate. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise apparatus that has all the advantages of the prior art exercise apparatus and none of the disadvantages.

It is another object of the present invention to provide a new and improved exercise apparatus that may be easily and efficiently manufactured and marketed.

An even further object of the present invention is to provide a new and improved exercise apparatus that has a low cost of manufacture with regard to both materials and labor, and which accordingly is then susceptible of low prices of sale to the consuming public, thereby making such multipurpose storage unit and system economically available to the buying public.

Still another object of the present invention is to provide a new exercise apparatus that provides in the apparatuses and methods of the prior art some of the advantages thererof, while simultaneously overcoming some of the disadvantages normally associated therewith.

Even still another object of the present invention is to provide a exercise apparatus having a riser extension attached at the bottom rear portion of a foot plate. This makes it possible to allow a user to tone or strengthen the user's calve muscles by rocking the foot plate up and down while maintaining contact with a floor surface with the riser extension.

Yet another object of the present invention is to provide a thigh harness connected to the foot plate with at least one tension member. This makes it possible to allow apply a resistive force, i.e., the tension member, while rocking the foot plate up and down which allows a user to tone or strengthen the user's calve muscles while rocking the foot plate up and down.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
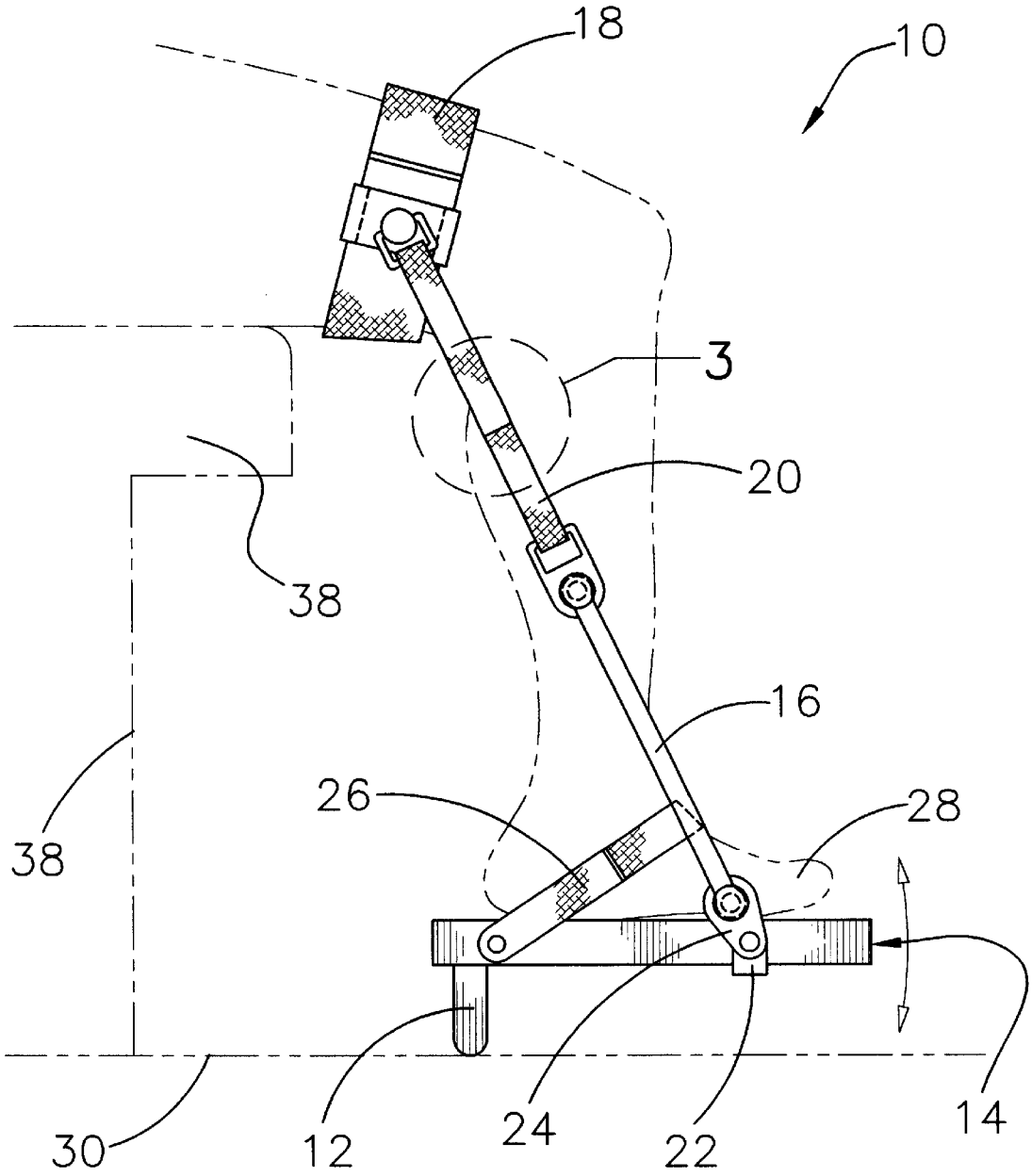
FIG. 1 is a perspective side view of the preferred embodiment of the exercise apparatus constructed in accordance with the principles of the present invention.

Referring now to the drawings, and in particular FIG. 1 to 5 thereof, one preferred embodiment of the present invention is shown and generally designated by the reference numeral 10. The exercise apparatus 10 comprises: a riser extension 12; a foot plate 14 attached to the riser extension 12, in which the riser extension 12 is attached to the bottom rear portion of the foot plate 14; a means for securing a users foot 28 onto the foot plate 14; left and right tension members 16 attached at the bottom ends of the left and right tension members 16 to the corresponding left and right front portions of the foot plate 14, respectively; and a thigh harness 18 attached at the left and right sides of the thigh harness 18 to the corresponding top ends of the left and right tension members 16, respectively.

Another embodiment of the present invention of the exercise apparatus 10 for conditioning and strengthening calve muscles comprises: a riser extension 12; a foot plate 14 attached to the riser extension 12, wherein the riser extension 12 is attached to the bottom rear portion of the foot plate 14; a means for securing a users foot 28 onto the foot plate 14; a tension member 16 attached at the middle portion of the tension members 16 to the bottom front portion of the foot plate 14; a thigh harness 18 attached at the left and right sides of the thigh harness 18 to the corresponding two ends of the tension member, respectively.

Yet another embodiment of the present invention of the exercise apparatus 10 for conditioning and strengthening calve muscles comprises: a riser extension 12; a foot plate 14 attached to the riser extension 12, wherein the riser extension 12 is attached to the bottom rear portion of the foot plate 14; an ankle strap 26 attached at the ends of the ankle strap 26 to the left and right rear portions of the foot plate 14; left and right tension members 16 attached at the bottom ends of the left and right tension members 16 to the corresponding left and right front portions of the foot plate 14, respectively; left and right straps 20 attached at the bottom ends of the left and right straps 20 to the corresponding left and right rear portions of the foot plate 14, respectively; a lower thigh harness 18*a* attached at the left and right sides of the lower thigh harness 18*a* to the top ends of the corresponding left and right tension members 16, respectively; an upper thigh harness 18*b* attached at the left and right sides of the middle thigh harness 18 to the top ends of the corresponding left and right straps 20, respectively; left and right upper support bars 32 attached at the proximate end of the left and right upper support bars 32 to the corresponding left and right sides of the upper thigh harness 18*b*, respectively, wherein the middle portions of the left and right upper support bars 32 are attached to the corresponding left and right sides of the lower thigh harness 18*a*, respectively; left and right lower support bars 34 pivotally attached at the proximate ends of the left and right lower support bars 34 to the corresponding distal ends of the left and right upper support bars 32, respectively; and a calve harness 36 attached at the left and right sides of the calve harness 36 to the corresponding distal ends of the left and right lower support bars 34, respectively.

The thigh harness 18 of the exercise apparatus 10 may optionally comprise left and right straps 20 attached at the top ends of the left and right straps 20 to the corresponding left and right sides of the thigh harness 18, respectively, in which the bottom ends of the optional left and right straps 20 are attached to the corresponding top ends of the left and right tension members 16, respectively. The straps 20 may optionally be capable of being adjusted lengthwise.

The foot plate 14 of the exercise apparatus 10 may optionally further comprises a U-shaped brace 22 attached to the bottom front portion of the foot plate 14, the U-shaped brace 22 traverses laterally underneath the foot plate 14 and upwardly about the left and right sides of the foot plate 14, in which the bottom ends of the left and right tension members 16 are attached to the corresponding left and right sides of the U-shaped brace 22. The foot plate 14 may further optionally comprises: a U-shaped brace 22 attached to the bottom front portion of the foot plate 14, the U-shaped brace 22 traverses laterally underneath the foot plate 14 and upwardly about the left and right sides of the foot plate 14; and left and right pivot plates 24 attached to the left and right sides of the U-shaped brace 22, respectively, wherein the bottom ends of the left and right tension members 16 are attached to the corresponding left and right pivot plates 24. Another optional embodiment of the foot plate 14 may comprise: a U-shaped brace 22 attached to the bottom front portion of the foot plate 14, the U-shaped brace 22 traverses laterally underneath the foot plate 14 and upwardly about the left and right sides of the foot plate 14; and left and right straps 20 attached at the corresponding left and right sides of the U-shaped brace 22, respectively, wherein the top ends of the left and right straps 20 are attached to the corresponding bottom ends of the left and right tension members 16, respectively. Even yet another optional embodiment of the foot plate 14 of the exercise apparatus may comprise: a U-shaped brace 22 attached to the bottom front portion of the foot plate 14, the U-shaped brace 22 traverses laterally underneath the foot plate 14 and upwardly about the left and right sides of the foot plate 14; left and right pivot plates 24 attached to the corresponding left and right sides of the U-shaped brace 22, respectively; and left and right straps 20 attached at the bottom ends of the left and right straps 20 to the corresponding left and right pivot plates 24, respectively, wherein the top ends of the left and right straps 20 are attached to the corresponding bottom ends of the left and right tension members 16, respectively.

The means for securing a users foot 28 may comprise any number of different ways of restraining a users foot 28 onto the foot plate 14. The means for securing is selected from the group consisting of an ankle strap 26, a shoe and a toe stop. One preferred optional embodiment of the means for securing is an ankle strap 26 attached at the ends of the ankle strap 26 to the left and right rear portions of the foot plate 14.

The tension members 16 of the exercise apparatus 10 may comprise any number of different means of providing a resistive force, such as selected from the group consisting of a spring, a variable resistance spring, an elastic cord, a rubber strap, and a pressure shock. One preferred optional embodiment of the tension members is a rubber strap. Furthermore, the tension members 16 of the exercise apparatus 10 may optionally be removably attachable to the foot plate 14 and to the thigh harness 18.

Figure 2:
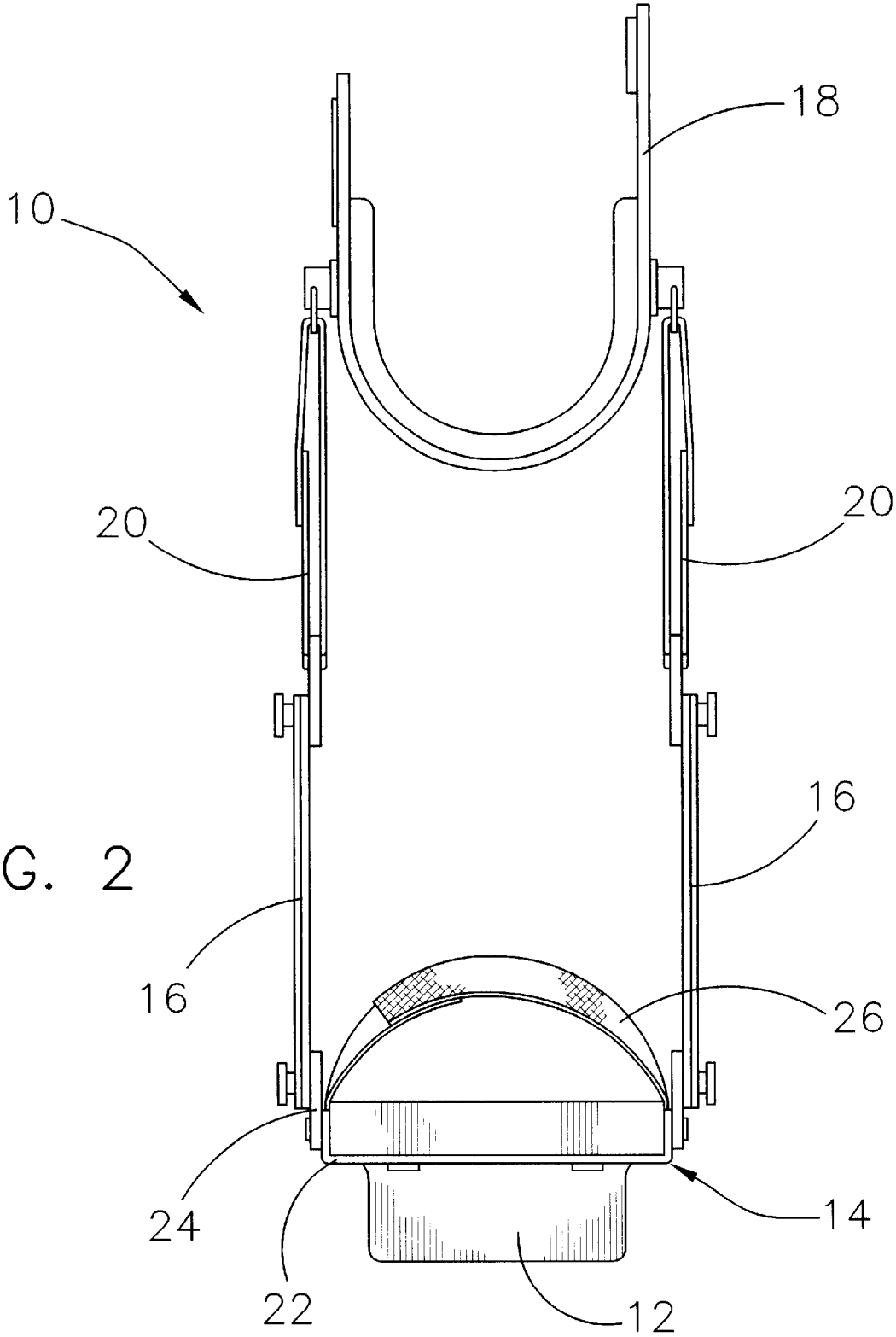
FIG. 2 is a plan view of the exercise apparatus of the present invention.

Referring to FIG. 1 and FIG. 2, the new and improved exercise apparatus 10 of the present invention for conditioning and strengthening calve muscles is illustrated and will be described. More particularly, this embodiment of the exercise apparatus 10 is shown having a foot plate 14 attached to the riser extension 12, in which the riser extension 12 is attached to the bottom rear portion of the foot plate 14. The means for securing a users foot 28 is an ankle strap 26 attached at the ends of the ankle strap 26 to the left and right rear portions of the foot plate 14. The foot plate 14 further is shown having a U-shaped brace 22 which traverses laterally underneath the foot plate 14 and upwardly about the left and right sides of the foot plate 14. The foot plate 14 further is shown having left and right pivot plates 24 pivotally attached to the corresponding left and right sides of the U-shaped brace 22, respectively. The left and right straps 20 are shown attached at the bottom ends of the left and right straps 20 to the corresponding left and right pivot plates 24, respectively. Finally, the top ends of the left and right straps 20 are attached to the corresponding bottom ends of the left and right tension members 16, respectively. The left and right tension members 16 are shown attached at the bottom ends of the left and right tension members 16 to the corresponding left and right front portions of the foot plate 14, respectively; and a thigh harness 18 attached at the left and right sides of the thigh harness 18 to the corresponding top ends of the left and right tension members 16, respectively.

Figure 3:
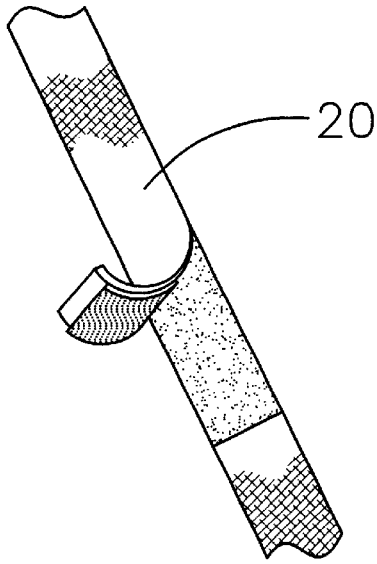
FIG. 3 is a perspective view of one of the optional strap element of the exercise apparatus of the present invention.

Referring now to FIG. 3, which is a perspective view of one of the optional strap 20 element of the exercise apparatus of the present invention. The optional strap 20 elements may comprise any number of different means for providing a means of achieving a desired tightness between the thigh harness 18 and the foot plate 14. Such as a buckle with a belt style connector, two straps linkable by press-slides, clips or hooks, or as shown an easily attachable and detachable hook-and-loop material, for example as that known as the trademarked material of VELCRO.

Figure 4:
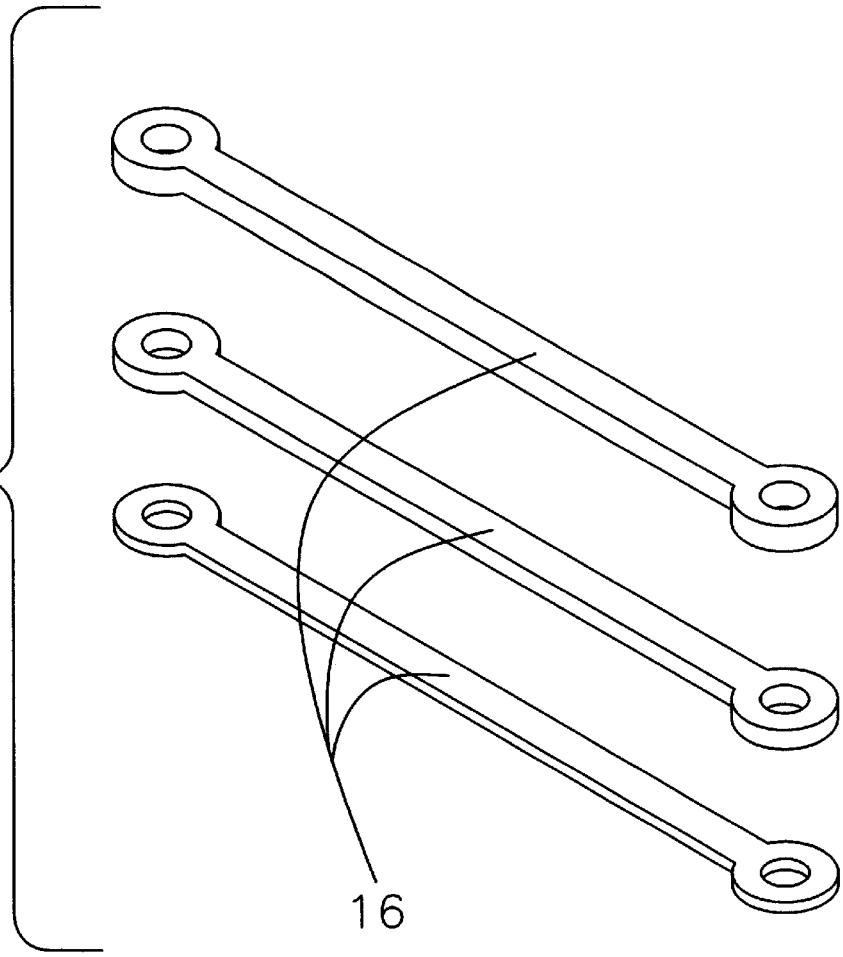
FIG. 4 is a perspective view of one of the embodiments of the tension members of the exercise apparatus of the present invention.

Referring to FIG. 4, which is a perspective view of one of the embodiments of the tension members of the exercise apparatus 10 of the present invention. The tension members 16 of the exercise apparatus 10 may comprise any number of different means of providing a resistive force, such as selected from the group consisting of a spring, a variable resistance spring, an elastic cord, a rubber strap, and a pressure shock. One preferred optional embodiment of the tension members is a rubber strap as shown in FIG. 4. Furthermore, the tension members 16 of the exercise apparatus 10 may optionally be removably attachable to the foot plate 14 and to the thigh harness 18.

Figure 5:
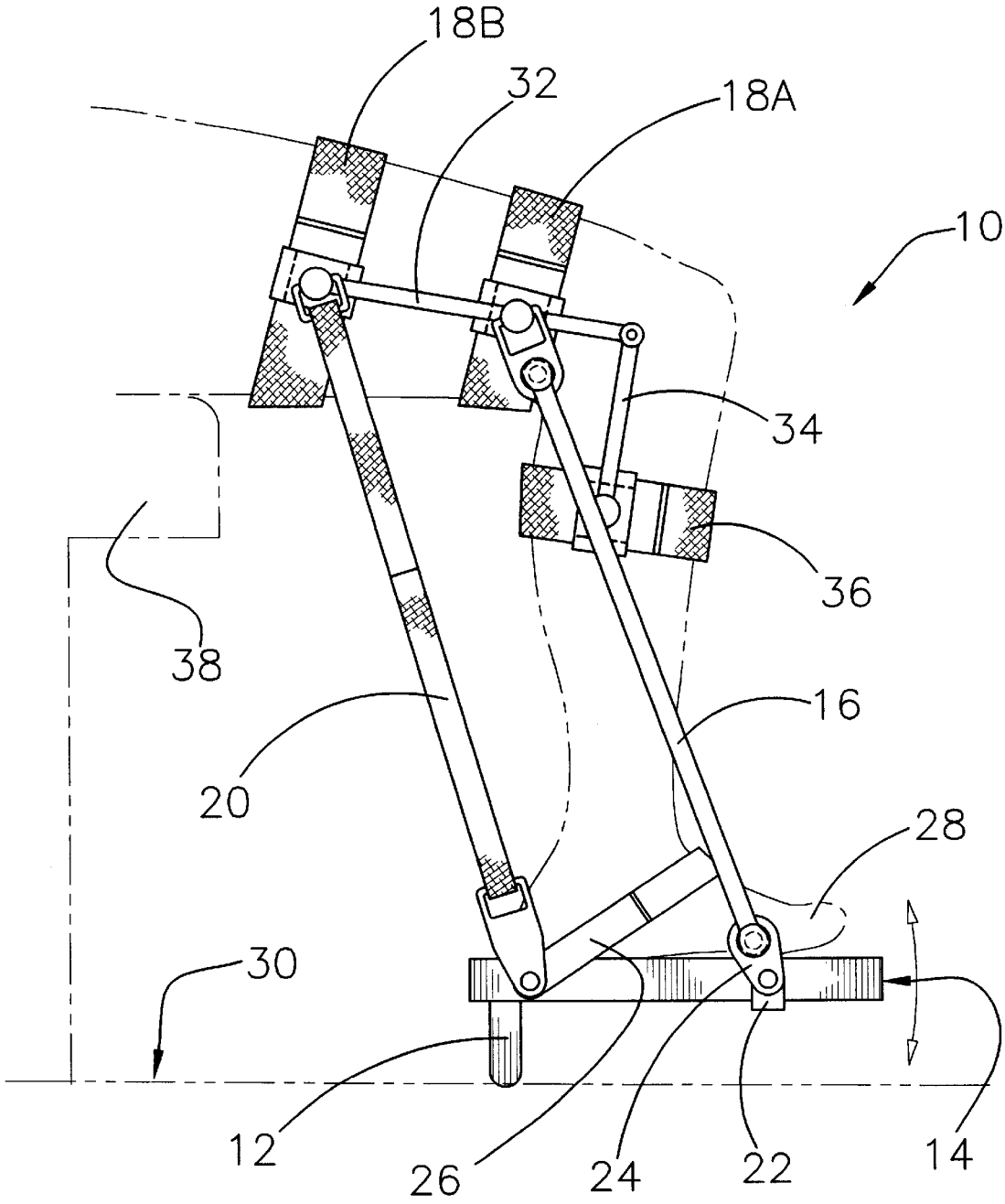
FIG. 5 is a perspective side view of another preferred embodiment of the exercise apparatus constructed in accordance with the principles of the present invention.

Referring to FIG. 5, a perspective side view of another preferred embodiment of the exercise apparatus 10 constructed in accordance with the principles of the present invention is shown. The exercise apparatus 10 comprises a foot plate 14 attached to the riser extension 12, in which the riser extension 12 is attached to the bottom rear portion of the foot plate 14. The means for securing a users foot 28 is an ankle strap 26 attached at the ends of the ankle strap 26 to the left and right rear portions of the foot plate 14. The foot plate 14 further is shown having a U-shaped brace 22 which traverses laterally underneath the foot plate 14 and upwardly about the left and right sides of the foot plate 14. The foot plate 14 further is shown having left and right pivot plates 24 pivotally attached to the corresponding left and right sides of the U-shaped brace 22, respectively. The left and right tension members 16 are shown attached at the bottom ends of the left and right tension members 16 to the corresponding left and right pivot plates 24, respectively. The top ends of the left and right tension members 16 are shown attached to the corresponding left and right sides of the lower thigh harness 18*a*. The left and right straps 20 are shown attached at the bottom ends of the left and right straps 20 to the corresponding left and right rear portions of the foot plate 14, respectively. An upper thigh harness 18*b* is shown attached at the left and right sides of the middle thigh harness 18 to the top ends of the corresponding left and right straps 20, respectively. The left and right upper support bars 32 are shown attached at the proximate end of the left and right upper support bars 32 to the corresponding left and right sides of the upper thigh harness 18*b*, respectively. The middle portions of the left and right upper support bars 32 is shown attached to the corresponding left and right sides of the lower thigh harness 18*a*, respectively. The left and right lower support bars 34 are shown pivotally attached at the proximate ends of the left and right support bar to the corresponding distal ends of the left and right upper support bar, respectively. Finally a calve harness 36 is shown attached at the left and right sides of the calve harness 36 to the corresponding distal ends of the left and right lower support bars 34, respectively.

As to the manner of usage and operation of the present invention, the same should be apparent from the above description. The user may sit on a chair 38 while wearing the exercise apparatus 10, in which rocking up and down the foot plate 14 while simultaneously contacting the bottom of the riser extension 12 to a floor surface 30. Thereby, conditioning and strengthening the calve muscles of the user. Accordingly, no further discussion relating to the manner of usage and operation will be provided.

While a preferred embodiment of the exercise apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. An exercise apparatus for conditioning and strengthening calve muscles, said exercise apparatus comprising:

a riser extension;

a foot plate attached to said riser extension, wherein said riser extension is attached to the bottom rear portion of said foot plate;

a means for securing a users foot onto said foot plate;

left and right tension members attached at the bottom ends of said left and right tension members to the corresponding left and right front portions of said foot plate, respectively; and a thigh harness attached at the left and right sides of said thigh harness to the corresponding top ends of said left and right tension members, respectively, wherein said riser extension extends downwardly beyond the bottom front portion of said footplate.

2. The exercise apparatus described in claim 1 wherein said thigh harness further comprising left and right straps attached at the top ends of said left and right straps to the corresponding left and right sides of said thigh harness, respectively, wherein the bottom ends of said left and right straps are attached to the corresponding top ends of said left and right tension members, respectively.

3. The exercise apparatus described in claim 2 wherein each strap is capable of being adjusted lengthwise.

4. The exercise apparatus described in claim 1 wherein said tension members are removably attachable to said foot plate and to said thigh harness.

5. The exercise apparatus described in claim 1 wherein said foot plate further comprises a U-shaped brace attached to the bottom front portion of said foot plate, said U-shaped brace traverses laterally underneath said foot plate and upwardly about the left and right sides of said foot plate, wherein the bottom ends of said left and right tension members are attached to the corresponding left and right sides of said U-shaped brace.

6. The exercise apparatus described in claim 1 wherein said foot plate further comprises:

a U-shaped brace attached to the bottom front portion of said foot plate, said U-shaped brace traverses laterally underneath said foot plate and upwardly about the left and right sides of said foot plate; and left and right pivot plates attached to the left and right sides of said U-shaped brace, respectively, wherein the bottom ends of said left and right tension members are attached to the corresponding left and right pivot plates.

7. The exercise apparatus described in claim 1 wherein said foot plate further comprises:

a U-shaped brace attached to the bottom front portion of said foot plate, said U-shaped brace traverses laterally underneath said foot plate and upwardly about the left and right sides of said foot plate; and left and right straps attached at the corresponding left and right sides of the U-shaped brace, respectively, wherein the top ends of said left and right straps are attached to the corresponding bottom ends of said left and right tension members, respectively.

8. The exercise apparatus described in claim 1 wherein said foot plate further comprises:

a U-shaped brace attached to the bottom front portion of said foot plate, said U-shaped brace traverses laterally underneath said foot plate and upwardly about the left and right sides of said foot plate;

left and right pivot plates attached to the corresponding left and right sides of said U-shaped brace, respectively; and left and right straps attached at the bottom ends of said left and right straps to the corresponding left and right pivot plates, respectively, wherein the top ends of said left and right straps are attached to the corresponding bottom ends of said left and right tension members, respectively.

9. The exercise apparatus described in claim 1 wherein said means for securing is an ankle strap attached at the ends of said ankle strap to the left and right rear portions of said foot plate.

10. The exercise apparatus described in claim 1 wherein said means for securing is a shoe attached to the foot plate.

11. The exercise apparatus described in claim 1 wherein said means for securing is a toe stop attached to the foot plate.

12. The exercise apparatus described in claim 1 wherein said means for securing is selected from the group consisting of a strap, a shoe and a toe stop.

13. The exercise apparatus described in claim 1 wherein the tension members are selected from the group consisting of a spring, a variable resistance spring, an elastic cord, a rubber strap, and a pressure shock.

14. An exercise apparatus for conditioning and strengthening calve muscles, said exercise apparatus comprising:

a riser extension;

a foot plate attached to said riser extension, said front plate having a top and bottom with front and rear portions thereon; wherein said riser extension is attached to the bottom rear portion of said foot plate;

a means for-securing a users foot onto said foot plate;

a tension member attached to bottom front portion of said foot plate; and a thigh harness attached at the left and right sides of said thigh harness to the corresponding two ends of said tension member, respectively.

15. The exercise apparatus described in claim 14 wherein said means for securing is a shoe attached to the foot plate.

16. The exercise apparatus described in claim 14 wherein said means for securing is selected from the group consisting of a strap, a shoe and a toe stop.

17. The exercise apparatus described in claim 14 wherein said tension member is selected from the group consisting of a spring, a variable resistance spring, an elastic cord, a rubber strap and a pressure shock.

18. An exercise apparatus for conditioning and strengthening calve muscles, said exercise apparatus comprising:

a riser extension;

a foot plate attached to said riser extension, wherein said riser extension is attached to the bottom rear portion of said foot plate;

a means for securing a users foot onto said foot plate;

left and right tension members attached at the bottom ends of said left and right tension members to the corresponding left and right front portions of said foot plate, respectively;

left and right straps attached at the bottom ends of said left and right straps to the corresponding left and right rear portions of said foot plate, respectively;

a lower thigh harness attached at the left and right sides of said lower thigh harness to the top ends of the corresponding left and right tension members, respectively;

an upper thigh harness attached at the left and right sides of said middle thigh harness to the top ends of the corresponding left and right straps, respectively;

left and right upper support bars attached at the proximate end of said left and right upper support bars to the corresponding left and right sides of said upper thigh harness, respectively, wherein the middle portions of said left and right upper support bars are attached to the corresponding left and right sides of said lower thigh harness, respectively;

left and right lower support bars pivotally attached at the proximate ends of said left and right support bar to the corresponding distal ends of said left and right upper support bar, respectively; and a calve harness attached at the left and right sides of said calve harness to the corresponding distal ends of said left and right lower support bars, respectively.

19. The exercise apparatus described in claim 18 wherein said foot plate further comprises a U-shaped brace attached to the bottom front portion of said foot plate, said U-shaped brace traverses laterally underneath said foot plate and upwardly about the left and right sides of said foot plate, wherein the bottom ends of said left and right tension members are attached to the corresponding left and right sides of said U-shaped brace.

20. The exercise apparatus described in claim 18 wherein said foot plate further comprises:

a U-shaped brace attached to the bottom front portion of said foot plate, said U-shaped brace traverses laterally underneath said foot plate and upwardly about the left and right sides of said foot plate; and left and right pivot plates attached to the left and right sides of said U-shaped brace, respectively, wherein the bottom ends of said left and right tension members are attached to the corresponding left and right pivot plates.

* * * * *